US007449639B2

(12) United States Patent
Nair

(10) Patent No.: US 7,449,639 B2
(45) Date of Patent: Nov. 11, 2008

(54) SHIELDED FLAT PAIR CABLE ARCHITECTURE

(76) Inventor: Rajendran Nair, 3838 E. Encinas Ave., Gilbert, AZ (US) 85234-3025

( * ) Notice: Subject to any disclaimer, the term of this patent is extended or adjusted under 35 U.S.C. 154(b) by 0 days.

(21) Appl. No.: 11/713,778

(22) Filed: Mar. 5, 2007

(65) Prior Publication Data

US 2008/0173465 A1 Jul. 24, 2008

Related U.S. Application Data

(63) Continuation of application No. 11/654,168, filed on Jan. 18, 2007.

(51) Int. Cl.
*H01B 7/00* (2006.01)

(52) U.S. Cl. ..... 174/113 R; 174/117 FF

(58) Field of Classification Search ..... 174/113 R, 174/117 FF

See application file for complete search history.

(56) References Cited

U.S. PATENT DOCUMENTS 5,789,711 A * 8/1998 Gaeris et al. ..... 174/113 C
6,340,795 B1 * 1/2002 Caldwell ..... 174/117 FF
6,974,906 B2 * 12/2005 Lo ..... 174/36
7,214,883 B2 * 5/2007 Leyendecker ..... 174/110 R

* cited by examiner

*Primary Examiner*—Chau N Nguyen

(57) ABSTRACT

A novel flat-wire-pair and cable architecture are disclosed. The invention implements flattened conducting wires coated with insulation that are bonded to each other, providing approximately rectangular cross-sections and flat surfaces for the transport of charge through the wires. Flat wire pairs are then placed within a cable assembly such that adjacent wire pairs are oriented orthogonally or in other such manner adjacent to each other to minimize crosstalk and render crosstalk common-mode. Flat wire pairs are also shielded for additional cross-talk minimization as well as near-field EMI minimization. A cable consisting of multiple flat wire pairs may also be shielded in its external jacket that maintains cable structure, and may include additional conductors for reference and static signals. Through these enhancements, the invention cable architecture eliminates intra-pair and inter-pair skew while substantially reducing signal loss due to skin-effect as well as rendering crosstalk harmless. Shielded flat wire pair cables are thus ideally suited to very high-speed data communication over significant distances.

16 Claims, 3 Drawing Sheets

Cross-section of a Shielded Flat Pair Cable (Preferred embodiment)

Diagrams
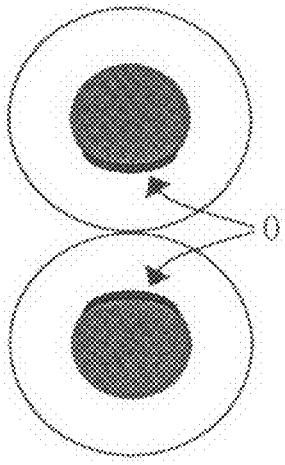
Figure 1: Cross section of a typical twisted wire pair (PRIOR ART)
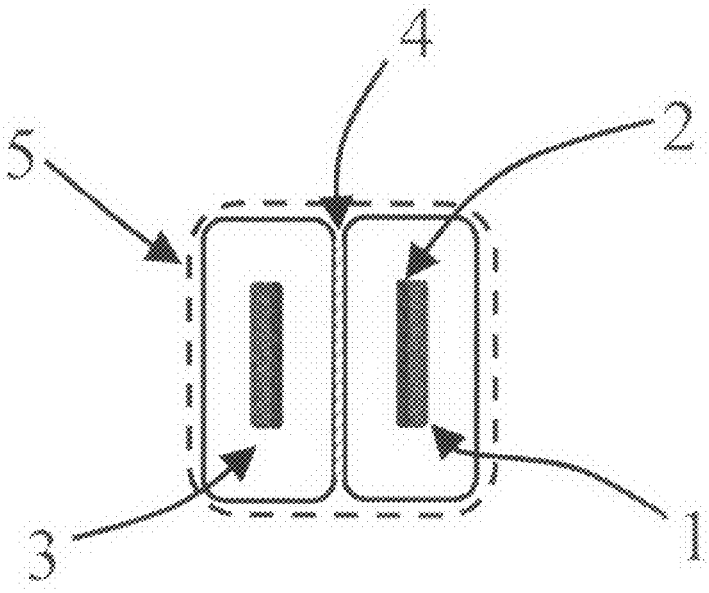
Figure 2: Cross section of a flat wire pair

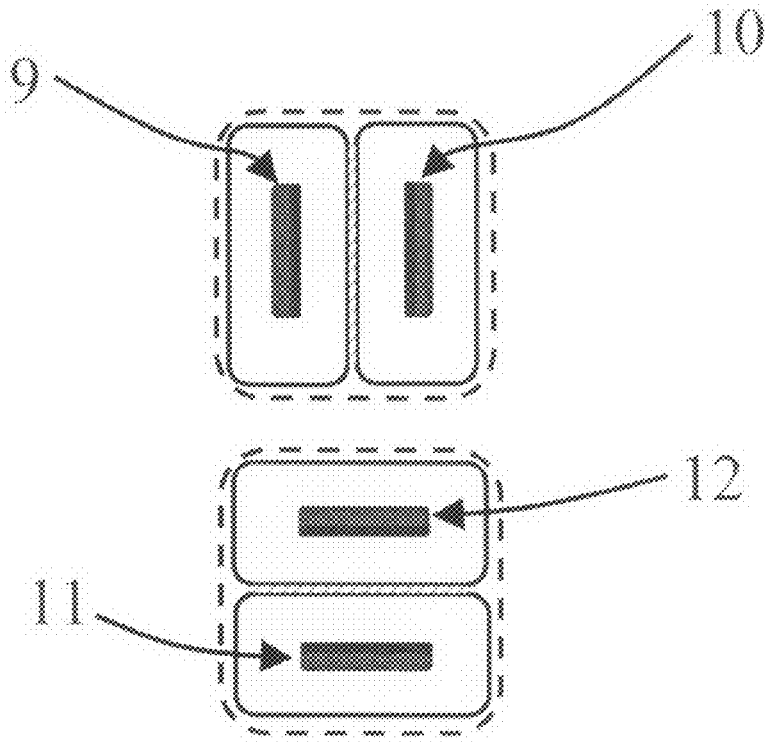
Figure 3: Orthogonal orientation of adjacent flat wire pairs
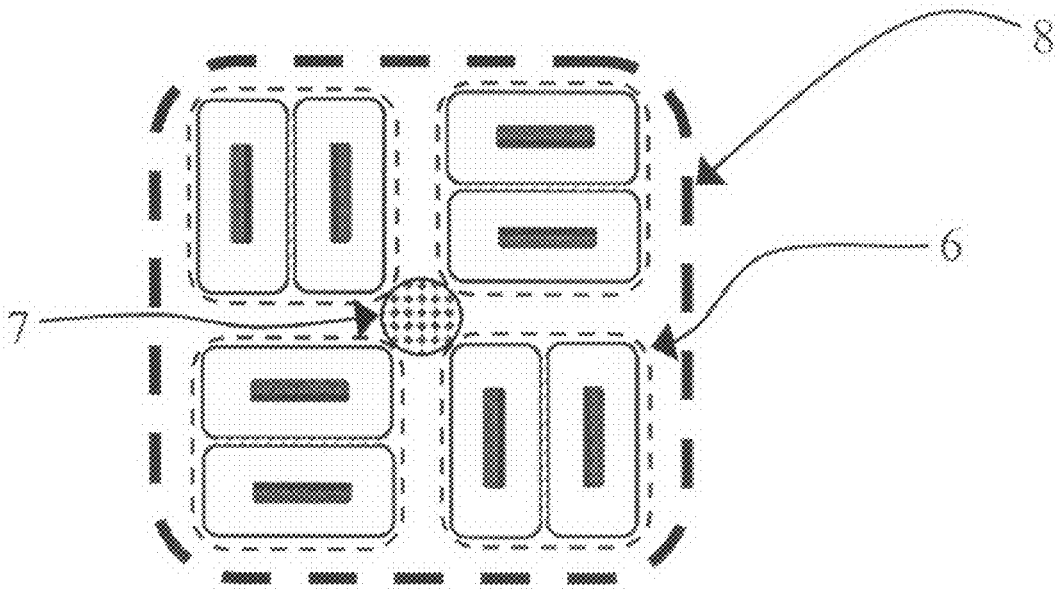
Figure 4: Cross-section of a Shielded Flat Pair Cable (Preferred embodiment)

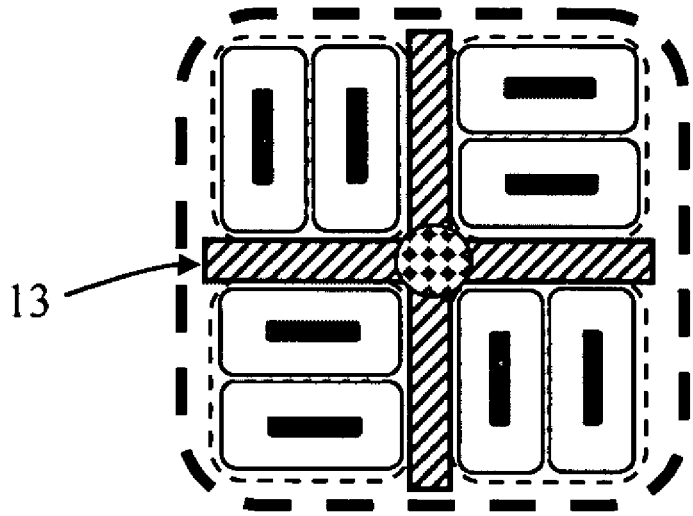
Figure 5: Alternate shielded flat-pair cable architecture

SHIELDED FLAT PAIR CABLE ARCHITECTURE

RELATED DOCUMENTS

This application is a continuation of U.S. utility patent application Ser. No. 11/654,168 filed Jan. 18, 2007, entitled "Shielded flat pair cable with integrated resonant filter compensation", the specification and claims of which are fully incorporated herein by reference.

TECHNICAL FIELD OF THE INVENTION

Embodiments of the invention relate to electronic wiring and cabling employed to conduct signals from point to point. Such embodiments fall under the category of wired interconnect components.

BACKGROUND & PRIOR ART

Interconnect has largely been considered a passive element in any system, providing sufficient but non-ideal connectivity between different parts of the system. In that manner, a prior art twisted wire pair, whose cross-section is illustrated in FIG. 1, provides good connectivity for signals flowing in the wires, but is prone to energy loss that is proportional to the data rate, or the frequency of the transmitted signals. Energy loss in twisted wire pairs takes two principal forms, series resistance losses due to the finite conductance of the wires as well as skin-effect, and parallel energy losses due to the insulation dielectric that separates the two wires of a wire pair from each other. Whereas skin-effect loss (the primary series loss component) increases as the square-root of the operating frequency, dielectric losses are directly proportional to the frequency. Both contribute to substantial signal attenuation at high data rates.

Additionally, electromagnetic coupling between wires, both near to, and at a distance from a signal wire contributes to distorting the signal conducted by the wire. Such undesirable coupling of signal energy, called 'crosstalk', takes two principal forms, capacitive and inductive. Capacitive coupling as the term indicates occurs due to the finite capacitance present between a signal wire and a coupling neighboring wire. Inductive coupling occurs due to the magnetic fields created by currents flowing in neighboring or distant wires that creates corresponding electro-motive force in the wire carrying the signal of interest. Both coupling phenomena lead to the addition of noise into a signal, degrading signal integrity and thereby increasing the probability of erroneous registration of the signal in a receiver system. Means of minimizing this degradation are therefore of much importance to communications systems employing wires to transmit signals.

The prior art twisted wire pair as well as standardized cables such as Cat-5e, Cat-6 (different categories) addresses such concerns of electromagnetic coupling. A wire pair consists of two individual wires coupled strongly and placed close to each other providing a means for 'differential signaling', a technique whereby a signal and its complement are transmitted simultaneously and the corresponding symbol recognized as the difference between the two electrical quantities received. Differential signaling largely eliminates concerns with any differences in ground or reference potentials between the communicating systems. Additionally, differential signaling makes it possible to employ high-gain amplifiers to recover an attenuated signal as long as the polarity relationship between individual signals of the differential pair is maintained. Thus, for example, a 1V swing binary, differential signal, with an effective difference between the two wires of 0.5V, may still be recognized correctly despite 10× attenuation down to 50 mV by a differential amplifier, provided that the polarity relationship between the true and complementary individual signals is maintained. Any distant-source noise that couples electro-magnetically into this wire pair couples in very much the same manner into both wires, thereby retaining the difference signal the same, and causing no significant degradation in signal integrity as long as the receiver differential amplifier is capable of rejecting this 'common-mode' noise. But a wire pair lying adjacent to another wire pair may not see such a benefit, such as in a flat-tape cable where signal wires as arranged in a bonded fashion adjacent to each other. This problem is effectively addressed by twisting the wires of the wire pair around each other. Over a sufficient length, because of the twist, the coupled noise from any adjacent signal wire sums out to be the same on both individual wires of a twisted wire pair, thus again rendering such noise 'common-mode'. As an additional enhancement, standard cables such as Cat-5e also offset the twists of wire pairs with respect to each other, starting with a low twist rate for one wire pair and tightening the twist rate for other included wire pairs in the cable assembly.

Twisted wire pairs also cancel out electromagnetic emissions from the signal wires, diminishing electromagnetic interference (EMI) with other systems. Perhaps the very first instance of such a brilliant application of this prior art is the twisting of the wires providing alternating current electricity to lamps and other electrical systems in buildings, minimizing the noise heard in entertainment radio devices. Additionally, twisted wires remain physically close, albeit somewhat inadequately, as a consequence of the intertwining of the wires, thus maintaining relative uniformity in their impedance and good coupling to each other.

Due to the reasons discussed, twisted wire pairs are very commonly employed for electrical signaling within electronic system boxes as well as between these boxes, such as between computers, and from video content players and high-definition displays. But as the volume of data exchanged continues to grow, some of the deficiencies of twisted wire pairs manifest themselves as limitations. A key such limitation is intra-pair skew, or the inequality in the total effective length of one wire with respect to the other in a wire pair. This asymmetry arises because of the independent manner in which the two wires are tensed and twisted with each other. The inequality typically increases with increasing length of the wire pair. In electrical terms, any such inequality in length gives rise to a delay difference between the traveling true and complement signal transitions in binary signaling, transforming part of the differential signal into a common-mode signal. For example, if the effective delay difference at the end of a long length of a wire pair is an inch, this will correspond to approximately 100 ps or more of delay difference at the end of the wire pair depending upon the insulator electrical characteristics. If a true and complement signal (a rising edge and a falling edge for voltage signals, for example) were to be launched simultaneously at the transmitter end on this wire pair, they would be offset at the receiver end of the wire pair by about 100 ps, potentially rendering the signals the same for 100 ps at the beginning of the symbol period and similarly for 100 ps at the end of the symbol period. In other words, 200 ps of the symbol information in certain symbol sequences is transformed from differential to common-mode, and if the receiver further requires at least 200 ps of differential signal for correct recognition with low error, the maximum bit-rate that may be transmitted on this wire pair, even with signals of high signal-to-noise ratio, would be approximately 1/(400 ps) or 2.5 Gbps. The duration of differential signal transformed to common-mode also leads to electromagnetic emissions from the wire pair. Intra-pair skew in twisted wire pairs is hence a severe limitation to link performance, as studies in the industry have indicated as well [Ref. 4].

Additionally, twisted wire pairs are also prone to impedance discontinuities that arise due to the physical separation of the wires of the wire pair that may arise due to assembly errors. As the frequency of data transmission through wire pairs increases, these impedance discontinuities become more significant and impact signal integrity. Attempts to correct such problems include very tight twisting as is done in improved cabling solutions in the industry [Ref. 5]. Such designs further increase effective electrical lengths of the twisted wire pairs, increasing inter-pair (between wire pairs) skew and thereby increasing synchronization challenges between signals flowing in wire pairs within a cable assembly. Inter-pair skew is a problem usually addressed by realignment circuits in receiver systems. Typical values of inter-pair skew in Cat-5e cables resulting from twist offset are more than 1 nS per 10 meters of length.

Twisted wire pairs also occupy about 4 times the physical volume of a single wire and lead to bulkier and relatively inflexible cable assemblies.

As the definition and quality of 2-D images and audio in multimedia transmission increases, there is a need for significantly higher data rates and correspondingly high frequencies of operation of such links as defined in the High Definition Multimedia Interface (HDMI) specification [1]. In view of the varied and significant limitations in prior art twisted wire pairs and cable assemblies, there is a need to improve upon wire pair construction and cable architecture for such links.

INVENTION SUMMARY

The invention implements flattened conducting wires coated with insulation that are bonded to each other, providing approximately rectangular cross-sections and flat surfaces for the transport of charge through the wires. Flat wire pairs are then placed such that adjacent wire pairs are oriented orthogonally to each other to minimize crosstalk and render crosstalk common-mode. Flat wire pairs are also shielded for additional cross-talk minimization as well as near-field EMI minimization. A cable consisting of multiple flat wire pairs may also be shielded in its external jacket that maintains cable structure. Through these enhancements, the invention cable architecture eliminates intra-pair skew while substantially reducing signal loss due to skin-effect. Because the wire pairs are untwisted, inter-pair skew is also largely eliminated.

BRIEF DESCRIPTION OF THE FIGURES

FIG. 1 illustrates a typical prior art TMDS twisted wire pair cross-section and skin-effect.

FIG. 2 is an illustration of the invention flat wire pair cross-section.

FIG. 3 is an illustration of the orthogonal placement of one flat wire pair adjacent to another.

FIG. 4 is a preferred embodiment of the shielded flat-pair cable architecture.

FIG. 5 is an alternate embodiment of the shielded flat-pair cable architecture.

DETAILED DESCRIPTION

A prior art twisted wire pair (TWP) cross-section is illustrated in FIG. 1. Key aspects of the design of such a transmission line pair include a fixed separation between the central axes of the two conducting wires, the diameter of the wires and the thickness as well as dielectric permittivity of the insulation coating both wires. The electric field between the two wires passes through the insulation between the wires as well as air space adjacent to them, given the circular nature of the cross section of the wires. The dimensions of the wires, their separation and the nature of the insulating material in between provide a value of inductance and capacitance per unit length that determine the characteristic impedance of the transmission line as the square-root of the ratio of the inductance to the capacitance. Prior art US patents [7] and [8] teach of techniques to be employed such that the individual wires are maintained at the same relative position with respect to each other in order to ensure that the impedance presented by the wire pair remains approximately constant over its twisted length.

A principal aspect of TWP's is the twist introduced into the wire pair along its length. This twist entwines both wires with each other and has significant advantages for the wire pair as well as the cable assembly. Not only does the twist cancel emissions through magnetic cancellation from the wire pair when a signal is transmitted 'differentially' through the wire pair, it also renders any noise introduced into the wires 'common-mode', or common to both wires. Additionally, by varying the rate of twist between wire pairs inside a cable assembly, noise coupled from one wire pair into an adjacent one is also diminished substantially provided the cable is of sufficient length. With these important advantages, twisted wire pairs may be used in unshielded fashion; Category 5 and 6 cables as defined by the TIA/EIA standards employ both unshielded twisted pair (UTP) and shielded twisted pair (STP) architectures.

Nevertheless, prior art wire pair twist introduces a significant disadvantage in the variation of the effective lengths between the two wires of the pair. This occurs because the wires are twisted independently around each other with mechanical limitations of the machinery determining the symmetry of the twist. In the extreme example, one can imagine one of the wires twisted around the other which is held straight. While such an extreme imbalance in twist is highly unlikely, prior art twisted wire pairs do suffer from a variance in the length of one wire with respect to the other, and this variance may accumulate over the length of the cable. A significant disparity in the effective length of one wire with respect to the other in a TWP leads to what is called 'intra-pair-skew' that becomes a key data rate limiting factor at high data rates. For example, an inch of difference in length between the two wires of a pair over a length of cable can lead to as much as 100 picoseconds of intra-pair skew, leading to approximately twice the duration being lost in the width of the received differential signal 'EYE'. This is because the positive pulse traveling on one line suffers a shift with respect to the negative pulse traveling on the companion line, thereby reducing the duration for which these pulses appear to be opposite to each other at the receiver. Reference publication [Ref 4] details the negative impact of twisted pair imbalance.

Intra-pair length variance and the associated intra-pair skew are effectively eliminated in the invention flat wire pair architecture illustrated in FIG. 2, also taught in more detail in U.S. utility patent application Ser. No. 11/654,168. With reference to FIG. 2 of this application, illustrating a cross-sectional area of the invention flat wire pair, 3 is the insulating material enclosing a flattened conductor 1 with a skin cross sectional area 2. 4 is a bonding layer that bonds two insulated flattened wires together and 5 is a shielding, conductive cover enclosing the flat wire pair. The process of fabrication of wires in the invention is very similar to that of the prior art wires in the TWP's with two exceptions. An additional step is added to flatten and smooth the surfaces of the conducting metal before it is coated with insulation, and another step is added to attach the two insulated wires together on their flat surfaces. These steps are described in detail in the previous application that this application is a continuation of.

Because the two insulated wires are bonded together, they are the same in physical or electrical length over any wire pair length. It will hence be evident to one skilled in the art that there is negligible variance in length or in other words, 'intra-pair skew' between the two wires of the flat wire pair. Additionally, both flat wires are covered with the same insulation material using identical processes and process control, and are bonded to each other on their flat surfaces, leading to a structure that maintains the separation and insulation characteristics between the two conducting wires of the wire pair over the length of the wire pair. This construction ensures that the impedance presented by the flat wire pair remains essentially constant over the entire length of the wire pair without a need for any other control mechanism as employed by prior art taught in [7] and [8]. It is important to note that prior art by Siekierka [8] teaches of an adhesively bonded wire pair architecture that is intended to provide the same benefit as that of the flat wire pair. The distinction between this prior art and the invention is that the invention provides a flat, and therefore substantially increased surface area for adhesive or thermally induced cohesive bonding, thereby providing a very robust bond between the wires of the wire pair. In contrast, as may be seen in FIGS. 2 and 3 of Siekierka [8], and as described in the specification of this prior art "The size of the adhesive is enlarged disproportionately to illustrate the bonding", the adhesion region is limited in substance and strength due to the circular cross section of the insulated wires that are bonded together. This prior art, therefore, is prone to separation of the wires of the wire pair due to mishandling of the cable including such wire pairs, such as bending or twisting. The prior art of Siekierka therefore requires additional enhancement in the form of the invention taught by Gareis [7] that provides additional support to a wire pair in the form of a tape wound helically over the twisted wire pair.

Another important advantage of the flat wire construction is the flat, smooth surfaces of the conducting wires, leading to significantly reduced skin-effect signal loss as detailed in utility application Ser. No. 11/654,168. This facilitates significantly higher data communication frequencies for the flat wire pair.

FIG. 3 illustrates the placement relationship of flat wire pairs within an invention cable assembly. With reference to this figure, 9 and 10 are conductors within a vertically oriented flat wire pair (vertical FWP) and 11 and 12 are conductors within a horizontally oriented flat wire pair (horizontal FWP). In this wire pair arrangement, it can be seen that conductor 12 is closer to conductors 9 and 10, as compared with conductor 11, and is therefore expected to couple some of its signal energy into conductors 9 and 10. This coupling of energy from one flat wire pair into another can be diminished greatly by shields jacketing each flat wire pair. Notwithstanding the presence of shields, the orientation of the flat wire pairs in the invention architecture assists in minimizing any negative impact of such energy coupling. In FIG. 3, any energy coupled from conductor 12 into conductor 9 is almost exactly the same as energy coupled from conductor 12 into conductor 10 by virtue of the 'orthogonal' arrangement of the two flat wire pairs. Such coupled energy therefore is rendered 'common-mode', or common to both victim signal wires, and is therefore effectively rejected by the differential receiver circuit at the receiver of the communications link. Conversely, energy coupled from conductors 9 and 10 into conductor 12 cancel each other out, since 9 and 10 carry signals that are exactly equal and opposite to each other. This is additionally assisted by the fact that flat wire pairs have inherently no intra-pair skew, ensuring that signals flowing in conductors 9 and 10 remain differential regardless of the length they have already traversed. Therefore there is no energy coupled into the horizontal FWP from the vertical FWP in the invention cabling arrangement illustrated in FIG. 3. Additionally, the shield covering of the flat wire pairs minimize any such potential crosstalk.

The invention cable architecture therefore obviates any need for twisting of wire pairs, while ensuring that crosstalk is minimized and rendered harmless. This benefit allows for the use of the shielded flat wire pair in untwisted form for any length necessary without incurring any of the consequences such as intra-pair or inter-pair skew or impedance variations of twisted wire pairs.

It is important to note that the orthogonality between adjacent flat wire pairs must be maintained throughout the length of the cable to ensure maximal benefit. This may be accomplished by close-fitting external jackets and conductive sheaths that provide an approximately square cross section to an entire cable assembly as illustrated in FIG. 4. With reference to this figure, 6 is one among the plurality of flat wire pairs in the cable, 7 is a cable core that follows the flat wire pairs along the length of the cable, and 8 is the external covering that encloses the flat wire pairs and the core within the cable assembly. FIG. 4 shows four flat wire pairs arranged such that each is orthogonal with respect to those adjacent. The four flat wire pairs assembled into the invention cable architecture match cables employed commonly in the networking industry that include four twisted wire pairs within. The cable core 7 in FIG. 4 may consist of additional insulated conductors for the purpose of conveying reference signals and/or include cable strengthening material that often accompany twisted wire pairs in prior art cables. The outer jacket 8 may be comprised of material that firmly holds the flat wire pairs as assembled, such as a material that shrinks permanently with the application of heat, and may also include highly conductive braiding or other such material employed for the communication of reference signals, such as a ground signal, between the transmitter and receiver. Shielding, conductive jackets on the flat wire pairs within the cable assembly may convey a different reference signal (such as the AVCC reference supply with respect to which differential signals are developed in HDMI transmissions) as compared with the external shield that most commonly carries a ground reference between the communicating systems.

FIG. 5 illustrates an alternate embodiment of the invention cable architecture. This embodiment includes a flat wire pair positioning core 13 comprised of a flexible material that assists in maintaining the orientations of the flat wire pairs with each other while also providing separation and isolation between these flat wire pairs. This further minimizes crosstalk conducted from one flat wire pair into another through contacting, conductive outer shields of the flat wire pairs. Such a flexible cable core also provides the cable assembly with additional mechanical strength as well as an invariable shape. The wire pair positioning core may also include additional insulated conductors for reference and other static signals. Such conductors in the cable assembly provide a measure of isolation between flat wire pairs within the cable assembly.

Although specific embodiments are illustrated and described herein, any component arrangement configured to achieve the same purposes and advantages may be substituted in place of the specific embodiments disclosed. This disclosure is intended to cover any and all adaptations or variations of the embodiments of the invention provided herein. All the descriptions provided in the specification have been made in an illustrative sense and should in no manner be interpreted in any restrictive sense. The scope, of various embodiments of the invention whether described or not, includes any other applications in which the structures, concepts and methods of the invention may be applied. The scope of the various embodiments of the invention should therefore be determined with reference to the appended claims, along with the full range of equivalents to which such claims are entitled. Similarly, the abstract of this disclosure, provided in compliance with 37 CFR §1.72(b), is submitted with the understanding that it will not be interpreted to be limiting the scope or meaning of the claims made herein. While various concepts and methods of the invention are grouped together into a single 'best-mode' implementation in the detailed description, it should be appreciated that inventive subject matter lies in less than all features of any disclosed embodiment, and as the claims incorporated herein indicate, each claim is to viewed as standing on its own as a preferred embodiment of the invention.

What is claimed is:

1. A cable, conducting differential signals, comprising:

A plurality of wire pairs, where each wire pair is comprised of two insulated, flattened wires, with substantially rectangular conductors and conformal insulation covering forming parallel surfaces, bonded immovably together with parallel flat surfaces of said wires facing each other over their length, and where wire pairs are placed within the cable adjacent to each other with rectangular conductors of any wire pair oriented orthogonal to rectangular conductors of any adjacent wire pair throughout the cable.

2. The cable of claim 1 with highly conductive covers over wire pairs.

3. The cable of claim 1 with a thermally shrunk protective cover serving to hold wire pairs in place and in their necessary orientation.

4. The cable of claim 1 where insulating material in flat wire pairs has a relative dielectric permittivity that is dependent upon, or varies with transmitted signal characteristics.

5. The cable of claim 1 where rectangular conductors in wire pairs comprise of copper or silver-plated copper.

6. The cable of claim 1 with a central, co-axial core separating wire pairs from each other.

7. The cable of claim 6, where the central, co-axial core comprises of one or more insulated conducting wires for static signal and direct current power transmission.

8. The cable of claim 6, with a highly conductive, protective outer cover employed as a shield or reference signal conduction pathway.

9. Electronic cables, circuits and systems transmitting electronic signals that employ the cable of claim 1.

10. A method for crosstalk minimization, comprising:

Providing wire pairs comprised of rectangular conductors and conforming insulation covers bonded immovably to each other, with such wire pairs placed adjacent to one another within a cable such that rectangular conductors within a wire pair are orthogonal in orientation to rectangular conductors within an adjacent wire pair;

where signal energy from a wire pair with conductors of a first orientation is cancelled out when coupling into conductors of an adjacent wire pair of a second orthogonal orientation, and signal energy from a conductor in the second orthogonally oriented wire pair couples as common-mode noise into conductors of the wire pair of the first orientation.

11. The method of claim 10 where wire pairs are separated from each other by a central core that is coaxial with the cable.

12. The method of claim 11 where the co-axial core comprises of conducting wires or other electrically conducting material providing additional wire pair to wire pair isolation.

13. Electronic cables and interconnect systems transmitting a plurality of electronic signals at employing the method of claim 10.

14. A method, for eliminating signal timing skew in conductors of a cable, comprising the use of untwisted wire pairs, comprised of rectangular conductors and conforming insulation covers bonded immovably to each other, placed adjacent to and equidistant from each other along the length of the cable, such that all wire pairs within said cable are oriented orthogonal to each other, and all conductors within the cable have the same physical length and electrical properties.

15. The method of claim 14 where all wire pairs exhibit the same differential electrical impedance and signal propagation velocity regardless of position within the cable.

16. Electronic cables and systems for signal transmission at high data rates that employ the method of claim 14.

* * * * *